United States Patent [19]

Mascherin

[11] 4,099,532

[45] Jul. 11, 1978

[54] COIN HOLDER HAVING RIB RETAINED CLOSURE

[76] Inventor: Enio Mascherin, 90 Glenhaven St., Toronto, Ontario, Canada, M6M 3M5

[21] Appl. No.: 763,407

[22] Filed: Jan. 28, 1977

[51] Int. Cl.[2] ..... G07D 1/08

[52] U.S. Cl. ..... 133/5 A

[58] Field of Search ..... 206/0.81, 0.82, 0.83; 133/1 R, 5 A, 1 A; 221/226, 236, 279; 312/71

[56] References Cited

U.S. PATENT DOCUMENTS

| | | | |
|---|---|---|---|
| 2,245,066 | 6/1941 | Bouchard | 133/5 A |
| 2,960,259 | 11/1960 | Aveni | 133/5A |

*Primary Examiner*—Stanley H. Tollberg

*Attorney, Agent, or Firm*—Robert D. Farkas

[57] ABSTRACT

An improved spring loaded coin or token holder that incorporates a locking-rotatable cover portion in cooperation with the spring urging the coins upward, such that the coins cannot accidentally be ejected from the holder when the cover is properly aligned.

6 Claims, 3 Drawing Figures

COIN HOLDER HAVING RIB RETAINED CLOSURE

BACKGROUND OF THE INVENTION

This invention relates to a spring loaded coin or token holder; more particularly to one wherein the holder is provided with a rotatable cover portion that prevents premature ejection of the coins.

The prior art teaches a variety of coin holders, for example, as disclosed in U.S. Pat. Nos. 2,436,646; 2,486,180; 2,729,325; 2,892,537; 3,105,592; 3,125,214; 3,448,851; 3,631,538; and others.

SUMMARY OF THE INVENTION

It is accordingly an object of the instant invention to provide for an improved spring loaded coin holder.

It is another object to provide for one having the aforementioned attributes.

It is a further object to provide for the same at relatively little cost thereby making it generally available.

These and other objects and advantages of the invention will become more apparent from a consideration of the following detailed disclosure and claims and by reference to the accompanying drawing, in which:

Figure 1:
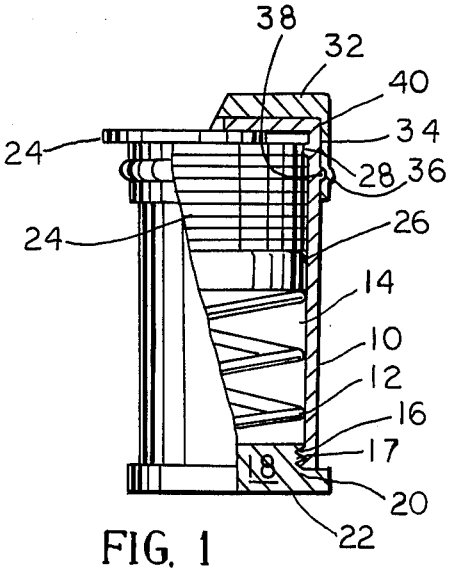
FIG. 1 is a longitudinal sectional view.
Figure 2:
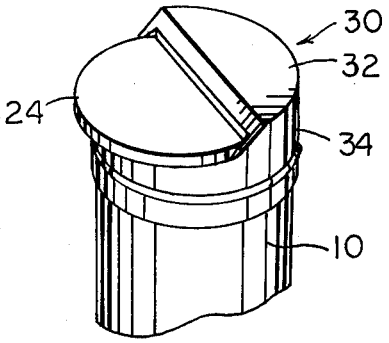
FIG. 2 is a front perspective.
Figure 3:
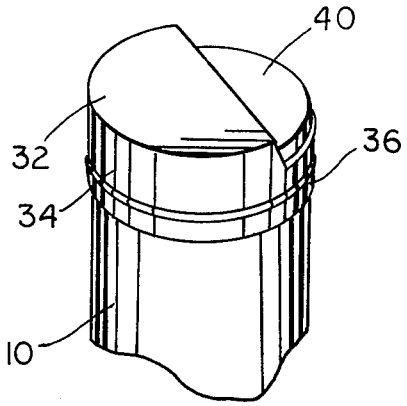
FIG. 3 is a rear perspective.

Broadly speaking, the instant invention includes the provision of a hollow container comprising a tubular walled body having an inner and outer surface and at least one open end, the body having a predetermined internal diameter, a cap portion removably engaging one end of the body, means for engaging the cap portion, a coiled spring disposed in the body, an annular rib disposed on the outer surface of the body, a partial wall covering at least a portion of the opposite end of the body, a cover member having a top portion and annular neck engaging the opposite end of the body, the neck including an annular recess communicating with the rib, the cover rotatable around the rib, the top portion being smaller than the diameter of the cover portion whereby when the top portion is axially aligned with the partial wall the body is at least partially opened and when the cover portion is rotated such that the top portion is not axially aligned with the partial wall the body is substantially closed.

DETAILED DISCLOSURE

Referring more particularly to the drawings, there is shown a generally tubular body 10 that is hollow and includes a conventional coil spring means 12 disposed therein in longitudinal alignment with the body 10, adjacent one distal end of the body 10, the interior wall 14 thereof is internally threaded 16 such that it can receive an externally threaded 17 cap or cover portion 18. The portion 18 generally has a neck 20 of reduced diameter relative to the head 22 or remainder thereof, the neck 20 mating with the body 10, the opposing threads engaging. The portion 18 is removable in case one wants to rear load the body 10 with coins or tokens 24 by first removing the spring 12 therefrom. The spring 12 is urged upward against the coin 24 disposed therebelow, a seat 26 generally therebetween; the coin 24 in turn being forced forward or upward towards the opposite distal end of the body 10. An annular collar or flange 28 disposed adjacent the open end of the body 10 prevents the coins 24 from merely falling thereoutof, however, they still may be prematurely removed by brushing action thereagainst. An annular cover portion 30 is provided herein which includes a top portion 32 that is not as large in diameter as the body 10, i.e., about one-half as large such that it effectively depresses the coin 24 yet permits the same to be withdrawn from the body 10. The portion 32 communicates with a neck portion 34 which includes an annular channel or indentation 36 that engages an annular rib 38 on the outer wall of the body 10. The cover portion 30 thus rotates about the body 10 along the rib 38. The internal diameter of the portion 30 thus being larger than the external diameter of the body 10. The distal end of the body 10 that receives the portion 30 has a partially closed end, that end is partially closed by an end portion 40 that effectively blocks at least a portion of the opening defined by the diameter of the body 10 such that the end portion or end wall 40 is seated just beneath the portion 32 when disposed on the body 10. As is apparent, when the portion 32 is in axial alignment with the portion 40, the coins are accessible and can be removed as the two portions (32, 40) effectively lie one atop the other, whereas, when the cover 30 is rotated, the portion 32 is brought in almost planar alignment, such that it covers the remainder of the open end of the body 10 left unblocked by the portion 40, the portions 32 and 40 now being contiguous and abutting as opposed to overlying. Generally, the diameter of portions 32 and 40 will be about the same, though they need not be, the proviso being that the portion 40 not completely cover the end of the body 10 and that the portion 32 be similarly sized.

Since it is obvious that numerous changes and modifications can be made in the above-described details without departing from the spirit and nature of the invention, it is to be understood that all such changes and modifications are included within the scope of the invention.

I claim:

1. A hollow container comprising a tubular walled body having an inner and outer surface and at least one open end, said body having a predetermined internal diameter, a cap portion removably engaging one end of said body, means for engaging said cap portion, a coiled spring disposed in said body, an annular rib disposed on the outer surface of said body, a partial wall covering at least a portion of the opposite end of said body, a cover member having a top portion and annular neck engaging said opposite end of said body, said neck including an annular recess communicating with said rib, said cover rotatable around said rib, said top portion being smaller than the diameter of said cover portion whereby when said top portion is axially aligned with said partial wall said body is at least partially opened and when said cover portion is rotated such that said top portion is not axially aligned with said partial wall said body is substantially closed.

2. The container as defined in claim 1 wherein said top portion and partial wall are approximately the same size.

3. The container as defined in claim 1 wherein said means includes a plurality of threads on said internal surface and a plurality of cooperating threads externally disposed on a portion of said cap portion, said portion mating with said body.

4. The container as defined in claim 3 wherein said portion is a neck of reduced diameter relative to the remainder of said cap portion.

5. The container as defined in claim 1 wherein said spring includes a seat disposed at one distal end thereof.

6. The container as defined in claim 1 wherein said body is adapted to receive and hold a plurality of stacked coins above said spring, said coins removable one at a time as biased upward in the direction of said cover portion by said spring.

* * * * *